US012043967B2

(12) United States Patent
Loar

(10) Patent No.: US 12,043,967 B2
(45) Date of Patent: Jul. 23, 2024

(54) AUTOMATIC TREATMENT MATERIAL SPREADER

(71) Applicant: Jakob Loar, North Lawrence, OH (US)

(72) Inventor: Jakob Loar, North Lawrence, OH (US)

( * ) Notice: Subject to any disclaimer, the term of this patent is extended or adjusted under 35 U.S.C. 154(b) by 322 days.

(21) Appl. No.: 17/522,149

(22) Filed: Nov. 9, 2021

(65) Prior Publication Data

US 2022/0178088 A1 Jun. 9, 2022

Related U.S. Application Data

(60) Provisional application No. 63/122,630, filed on Dec. 8, 2020.

(51) Int. Cl.

| | |
|---|---|
| ***E01C 19/00*** | (2006.01) |
| ***E01C 19/20*** | (2006.01) |
| ***E01H 5/06*** | (2006.01) |
| ***E01H 10/00*** | (2006.01) |

(52) U.S. Cl.

CPC ..... *E01C 19/201* (2013.01); *E01H 5/061* (2013.01); *E01H 10/007* (2013.01)

(58) Field of Classification Search

CPC ..... E01C 19/004; E01C 19/201; E01H 1/00; E01H 5/06; E01H 5/061; E01H 10/007

See application file for complete search history.

(56) References Cited

U.S. PATENT DOCUMENTS 10,687,461 B1 * 6/2020 Massengale ..... A01C 17/006
11,696,535 B2 * 7/2023 Friell ..... A01M 21/02 404/75
2014/0136023 A1 * 5/2014 Jaccoma ..... A01B 76/00 701/2
2023/0226568 A1 * 7/2023 Mandeville ..... E01H 10/007 239/722
2023/0264708 A1 * 8/2023 Lacaze ..... B60W 60/001 701/23
2023/0292680 A1 * 9/2023 Friell ..... E01C 19/52 404/75

FOREIGN PATENT DOCUMENTS

CN 213462961 * 6/2021
CN 216811051 * 6/2022

* cited by examiner

*Primary Examiner* — Gary S Hartmann

(74) *Attorney, Agent, or Firm* — Brennan, Manna & Diamond, LLC

(57) ABSTRACT

An automatic treatment material spreader device that is designed to automatically spread a treating material such as a salt or fertilizer for treating lawns, gardens, driveways, and parking lots. The device includes a rectangular body having a truck bed for storing treatment material, tank treads for mobility, and a funnel with rotating blades for metering and spreading the treatment material to a target area. The device is remotely controlled by an operator through a software application wherein the device can run on electrical supply provided through an internal battery. The internal batter can be charged by a wireless charging dock. The device can be programmed through the software application to spread the treatment material within a specified area and a specified treatment schedule. The device provides real time information about its location, material volume, and battery status.

4 Claims, 5 Drawing Sheets

AUTOMATIC TREATMENT MATERIAL SPREADER

CROSS-REFERENCE TO RELATED APPLICATION

The present application claims priority to, and the benefit of, U.S. Provisional Application No. 63/122,630, which was filed on Dec. 8, 2020 and is incorporated herein by reference in its entirety.

FIELD OF THE INVENTION

The present invention relates generally to the field of automatic devices for providing treatment material to specified or predetermined areas. More specifically, the present invention relates to an automatic treatment material spreader device for treating lawns, gardens, driveways and parking lots with appropriate treatment materials, such as salt and fertilizer. The device in the form of a rectangular body with tank treads and can be remotely controlled by an operator through a software application. A funnel with rotating blades enables the treatment material stored in a truck bed to be metered and spread in the target area. The device runs on electrical supply provided by an internal battery and is wirelessly charged by a wireless charging dock. The device can be programmed to spread the treatment material within a specified area, in a specified amount and in a specified treatment schedule. The device provides real-time information about the location, material volume and battery status of the spreader. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, a lot of snow can accumulate on driveways and parking lots during winter season. The accumulated snow makes the driveways and parking lots unfit for driving and walking. It can be difficult for homeowners and business owners to venture out from their houses and businesses to keep up with the required maintenance of removing snow from driveways and parking lots.

Conventional solutions and devices of manually spreading salt or other materials to treat accumulated snow is a time-consuming and labor-intensive task and is not feasible for everyone. Several other methods for removing the ice and snow on the road comprise artificial snow removal, snow melting for snow removal, and mechanical snow removal. The artificial snow removal is time-consuming and labor intensive, and has low sweeping efficiency. The snow melting method by using heat energy or chemical agent scattering consumes lots of energy and is high in cost. Also, the currently used mechanical snow removal devices are high in cost, poor in snow removal effect and inherently damage the road surface.

Similar problems are faced by individuals for spreading fertilizer on lawns and gardens. To nurture gardens, individuals presently need to perform manual operations and processes of feeding fertilizers to the soil which is a time-consuming and labor-intensive task.

Current solutions and devices demand a lot of effort from an operator which is difficult for the operator. Thus, in order to reduce the labor intensity of an operator, efficient and automatic devices are required for treating lawns, gardens, driveways and parking lots with appropriate treatment materials, such as salt and fertilizer, thereby greatly saving manpower requirements. Conventional systems and devices can also cause pollution to the environment and are, therefore, not environmentally-friendly. Also, in case of absence of an operator, current mechanical devices cannot be operated and are thus idle most of the time, leading to inefficiencies.

Therefore, there exists a long felt need in the art for a system and device to automatically spread treatment materials such as salt and fertilizers with limited manual intervention. There is also a long felt need in the art for a system and device for use with lawns, gardens, driveways and parking lots that can be treated in an effective and automated manner. Additionally, there is a long felt need in the art for a system and device that does not cause pollution and is easy to implement. Moreover, there is a long felt need in the art for a system, device and method that does not need the physical presence of an operator to treat the areas and apply treatment materials. Finally, there is a long felt need in the art for a system, device and method that provides a safer, more convenient, low cost, labor saving and effective method of providing treatment materials to a specified or predetermined area.

The subject matter disclosed and claimed herein, in one embodiment thereof, comprises an automatic treatment material spreader system that can be used to treat lawns, gardens, driveways, and parking lots by spreading treatment materials such as salt, fertilizers, etc. The automatic treatment material spreader system comprises a spreading device configured to be remotely controlled by an operator using a computer-implemented software application via a cloud server, and enables the operator to remotely access the spreading device to establish a location, a schedule, a treatment material and more. The treatment material spreader device comprises: a truck bed for storing treatment material; a hopper funnel connected to the truck bed for metering and spreading the stored treatment material; a GPS sensor to track a real-time location of the spreader device; a battery sensor to sense an internal battery level; and, a sensor to check the quantity of remaining treatment material in the truck bed. The spreader device can be coupled to a cloud server in order to transmit real-time sensor information to the cloud server which relays the information to the software application for the operator to monitor the status of the spreader device.

In this manner, the novel treatment material spreader device and system of the present invention accomplishes all of the forgoing objectives, and provides a relatively safe, easy, cost-effective and convenient solution to enable operators to automatically treat a target area without physically being present at the location. The treatment of the target area is done automatically as per the time and frequency preferences of the operator. The present invention provides an easy way to treat lawns, gardens, driveways and parking lots with the desired treatment material.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an automatic treatment material spreader system. The automatic treatment material system includes a spreading device configured to be remotely controlled by an operator using a computer-implemented software application via a cloud server and is configured to treat lawns, gardens, driveways and parking lots with the appropriate treatment materials, such as salt and fertilizer. The treatment material spreader device further comprises: a truck bed for storing treatment material; a hopper funnel connected to the truck bed for metering and spreading the stored treatment material; a GPS sensor to track real-time location of the spreader device; a battery sensor to sense internal battery level; and, a sensor to check the quantity of remaining treatment material in the truck bed. The spreader device can be coupled to a cloud server and transmits real-time sensor information to the cloud server which relays the information to the software application for the operator to monitor the status of the spreader device. Also, the spreader device is remotely controlled by the operator to specify and configure the treatment area and treatment schedule of the spreader device.

In a further embodiment of the present invention, a novel treatment material spreading device is disclosed. The spreading device is designed to automatically treat lawns, gardens, driveways and parking lots with the appropriate treatment materials, such as salt and fertilizer. The spreading device includes: a rectangular truck bed for storing treatment material; a spreader funnel coupled to the truck bed for metering the treatment material; rotating blades to spread the stored treatment material for treating a surface; tank treads for mobilization; an anti-theft GPS tracker to track the real-time location of the device; a removable front plow for snow plowing and having a proximity sensor for avoiding obstacles in front of the device; and, a wireless charging receiver device to receive wireless charging for charging a built-in battery. The spreading device includes an associated wireless charging station to wirelessly charge the spreading device and a refilling station to refill the truck bed with the treatment material. The spreading device can be connected to a software application for enabling an operator to remotely program a specified treatment area and a specified treatment schedule for spreading treatment material.

In a further embodiment of the present invention, a method for treating lawns, gardens, driveways and parking lots with appropriate treatment materials, such as salt and fertilizer, is described. The method includes: connecting a treatment material spreading device to a smartphone application; receiving an instruction containing a specified or predeterminable treatment area for spreading treatment material and a treatment schedule; automatically starting treatment of the treatment area by spreading the configured treatment material during the configured treatment schedule; wherein, the smartphone application displays the real-time location and treatment material level of the treatment material providing device. The device starts from a preset location at the start of the schedule and can move to the preset location at the end of the schedule. The preset location can be a wireless charging dock of the device for recharging the device.

In yet a further embodiment of the present invention, an automatic salt/fertilizer spreader with a front plow device is disclosed. The device includes a generally rectangular truck bed having a front portion and a rear portion. The front portion includes a spreader unit to spread treatment material to treat an area along with a detachable plow. The rear portion includes a wireless charging receiving device. The wireless charging receiving device is configured to receive wireless charging from a wireless charging dock wherein the charging dock also includes a treatment material refilling station to refill treatment material in the truck bed.

In yet a further embodiment of the present invention, the spreader unit of the automatic salt/fertilizer spreader with front plow device can be in the shape of a funnel to channel material to a plurality of dull and rotating blades to spread treatment materials while the spreader is in motion in order to treat the desired area.

In yet a further embodiment of the present invention, a computer-implemented software application for treating lawns, gardens, driveways and parking lots with the appropriate treatment materials, such as salt and fertilizer, is disclosed. The software application can be installed in a handheld electronic device and designed to remotely control an automatic treatment material spreader device. The software application provides interfaces to an operator to provide instructions for specifying treatment areas and treatment schedules for the spreader device. The software application can also display real-time notifications showing location, battery status and treatment material level to the operator.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
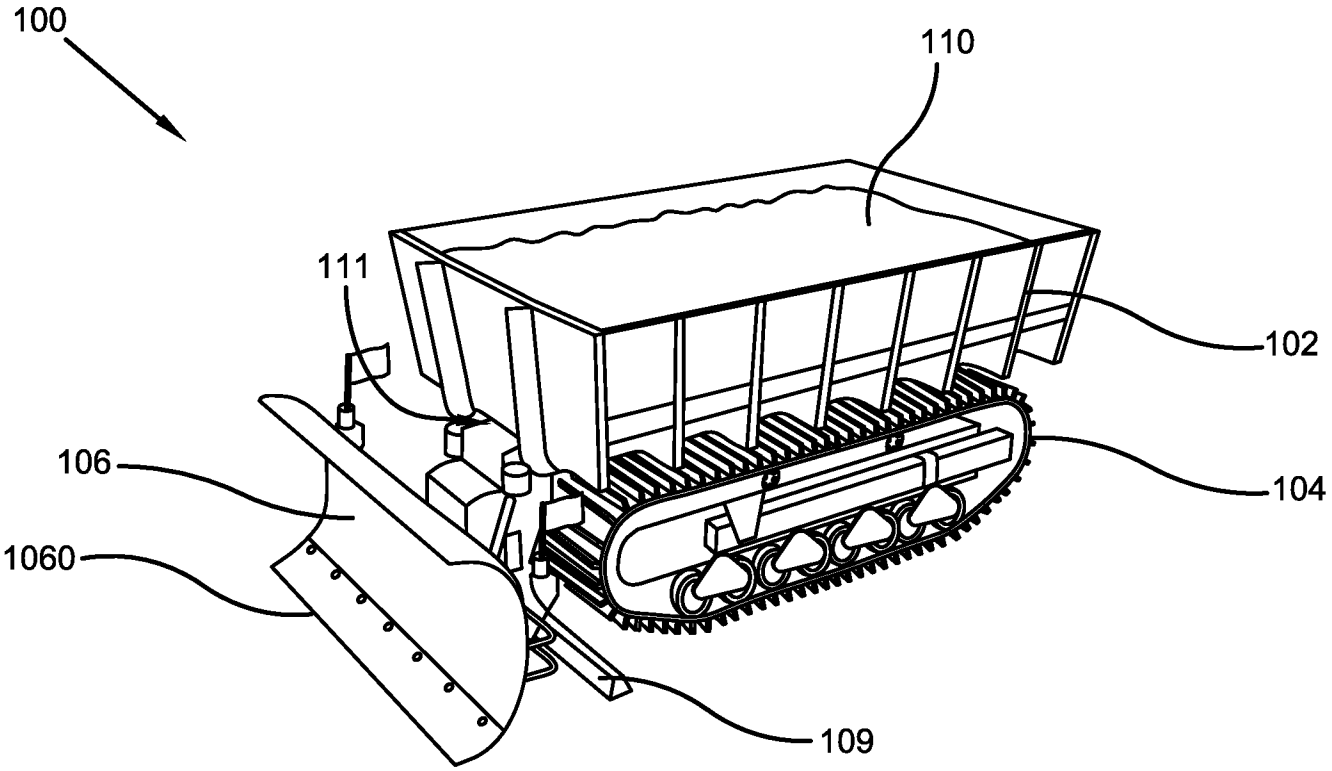
FIG. 1 illustrates a perspective view of one potential embodiment of an automatic salt and fertilizer spreader vehicle of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there a long felt need in the art for a system and device to automatically spread treatment materials such as salt and fertilizers without any manual labor. There is also a long felt need in the art for a system and device for use with lawns, gardens, driveways and parking lots that can be treated in an effective and automated manner. Additionally, there is a long felt need in the art for a system and device that does not cause pollution and is easy to implement. Moreover, there is a long felt need in the art for a system, device and method that does not need the physical presence of an operator to treat the areas and apply treatment materials. Finally, there is a long felt need in the art for system, device, and method that provides a safer, more convenient, low cost, labor saving and effective method of providing treatment materials to a specified area.

The present invention, in one exemplary embodiment, is a novel treatment material spreading device is disclosed, that is designed to automatically treat lawns, gardens, driveways and parking lots with the appropriate treatment materials, such as salt and fertilizer. The spreading device includes: a rectangular truck bed for storing treatment material; a spreader funnel coupled to the truck bed and having rotating blades to meter and spread the stored treatment material for treating a surface; tank treads for mobilization; an anti-theft GPS tracker to track the real-time location of the device; a removable front plow for snow plowing and having a proximity sensor for avoiding obstacles in front of the device; and, a wireless charging receiver device to receive wireless charging for charging a built-in battery. The spreading device includes an associated wireless charging station to wirelessly charge the spreading device and a refilling station to refill the truck bed with the treatment material. The spreading device can be operated using a compatible software application for enabling an operator to remotely program a specified or predetermined treatment area and a treatment schedule for spreading the treatment material.

Referring initially to the drawings, FIG. 1 illustrates a perspective view of one potential embodiment of an automatic salt and fertilizer spreader vehicle of the present invention in accordance with the disclosed architecture. The automatic salt and fertilizer spreader 100 of the present invention includes a tank-like device designed to automatically spread treatment materials such as salt and fertilizers in a specific area. The spreader vehicle 100 obviates the need for a driver to operate the vehicle 100 and enables an operator to control the operation of the vehicle 100 remotely through a smartphone application. Further, the spreader vehicle 100 can include an electrical vehicle and can be charged through a companion wireless charging station.

The spreader vehicle 100 includes a rectangular truck bed 102 for storing the treatment material 110 such as salt or fertilizer. The stored material 110 can be spread on the specified area using a funnel 108. The funnel 108 can include one or more dull and rotating blades 109 to meter and spread treatment materials 110 while the spreading vehicle 100 is in motion. The funnel 108 can be connected to the truck bed 102 for receiving the treatment material 110. The truck bed 102 can further include a spreading material conveyer belt 111 to continuously receive and move the material to a conduit 112 for feeding the funnel 108. The vehicle 100 can include a tank tread on each side of the vehicle 100 for traction and movement along any surface.

The spreader vehicle 100 can include a front plow 106 selectively connected to the main body through a fastening mechanism such as mechanical fasteners. The front plow 106 can be removably attached to the main body. The front plow 106 can be used for clearing snow and ice simultaneously with spreading of the treatment material. The front plow 106 can be constructed to include a lower resilient blade portion 1060 to enable clearing of snow. The front plow 106 further includes a proximity detection sensor for notifying a user, or the vehicle itself, about an obstacle that enables the vehicle 100 to maneuver and avoid any potential obstacle such as a tree, a barrier or a car.

The rotating blade 109 or deflector means associated with the spreading funnel 108 regulates the width of the distribution strip to be covered by the treatment material 110 being spread. In one potential embodiment, the rotating blades 109 can extend the entire length of the bottom of the hopper funnel 108 through such that material is dispensed as far forward and sideways as desired.

The hopper funnel 108 can be hydraulically operated to receive treatment material from the truck bed 102 and fed from the conveyor belt 111 in order to spread the material on any surface as per the preferences of an operator. The removable nature of the hopper funnel 108 and the front plow 106 permit adaptation of the use of the spreader vehicle 100 to other purposes when the vehicle is not used for material dispensing or spreading the treatment material 110.

The rectangular truck bed 102 is attached to the base portion and tank treads 104 through connecting means that are similar to the conventional means of attachment in traditional snow truck plows. One of the advantages of the vehicle 100 is that no pivotal movement of the truck bed 102 is required to spread the treatment material and the material is sprayed or dispensed in a uniform manner on the specified or predetermined surfaces. The material 110 stored in the truck bed 102 can be completely spread through the hopper funnel 108 without any manual labor or intervention from an operator.

The present invention obviates the need for a driver of the vehicle 100, therefore, to prevent theft and to track the location of the vehicle, the vehicle 100 includes a built-in GPS tracker enabling an operator to track the real-time location of the vehicle 100 on a paired electronic device having a tracking application (app).

Figure 2:
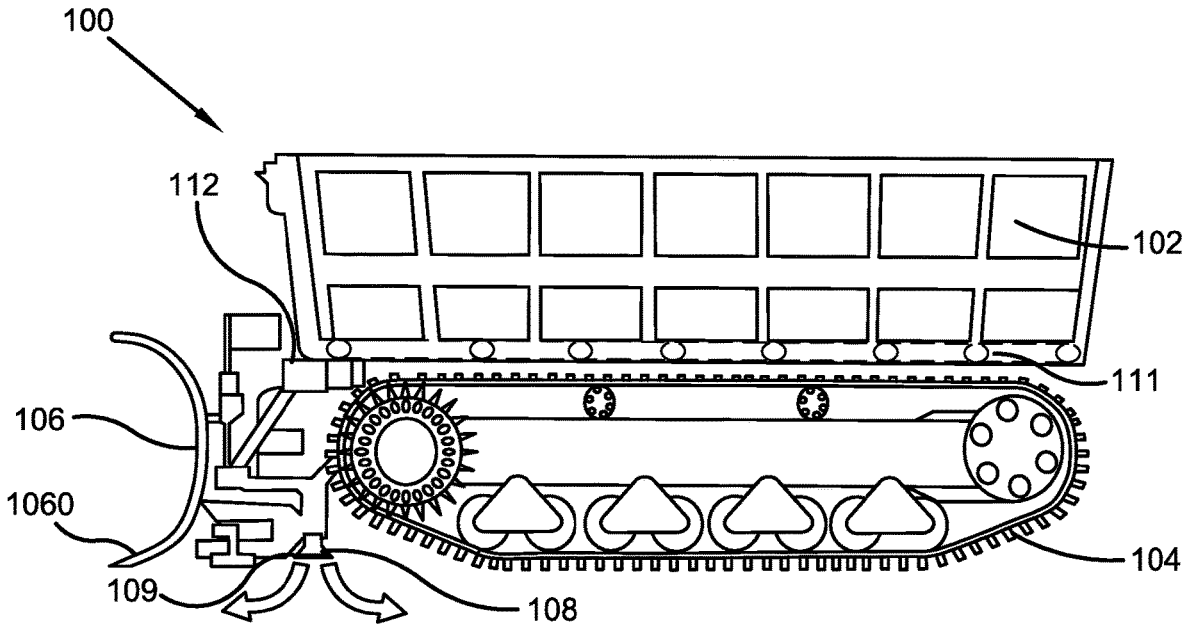
FIG. 2 illustrates a side plan view of one potential embodiment of the automatic salt and fertilizer spreader vehicle of the present invention in accordance with the disclosed architecture.

FIG. 2 illustrates a side plan view of one potential embodiment of an automatic salt and fertilizer spreader vehicle of the present invention in accordance with the disclosed architecture. The spreader vehicle 100 has the truck bed 102 connected to the base portion having tank treads 104. The tank treads 104 enable the movement of the vehicle 100 and a hopper funnel 108 runs across the width of the vehicle 100 to spread the treatment material such as salt or any fertilizer on specified or predeterminable surface such as a road or on a field. The automated mechanism of spreading the treatment material enables a secure and uniform operation without any manual labor.

The hopper funnel 108 can be hydraulically connected to the truck bed 102 through a conduit 112 that enables the material to travel through the truck bed 102 on a conveyor belt 111 to the hopper funnel 108 and blade 109 for spreading. The rotating blades 109 on the bottom surface of the hopper funnel 108 enables the spreading of the treatment material on the surface at a desired distance. The front plow 106 can be attached to the main frame of the vehicle 100 using a pair of mechanical fasteners 1060. The front plow 106 can be selectively removed from the main body as per the preferences of an operator.

In one potential embodiment, the hopper funnel 108 is attached to the front portion of the truck bed 102. As will be explained in detail, the rear portion of the truck bed 102 can include a wireless charging mechanism to enable a wireless charging station to wirelessly charge the internal battery of the vehicle 100. Also, a spreading material refill station can automatically and simultaneously replenish the material through the rear portion of the truck bed 102 from a refilling hopper at the wireless charging station.

Figure 3:
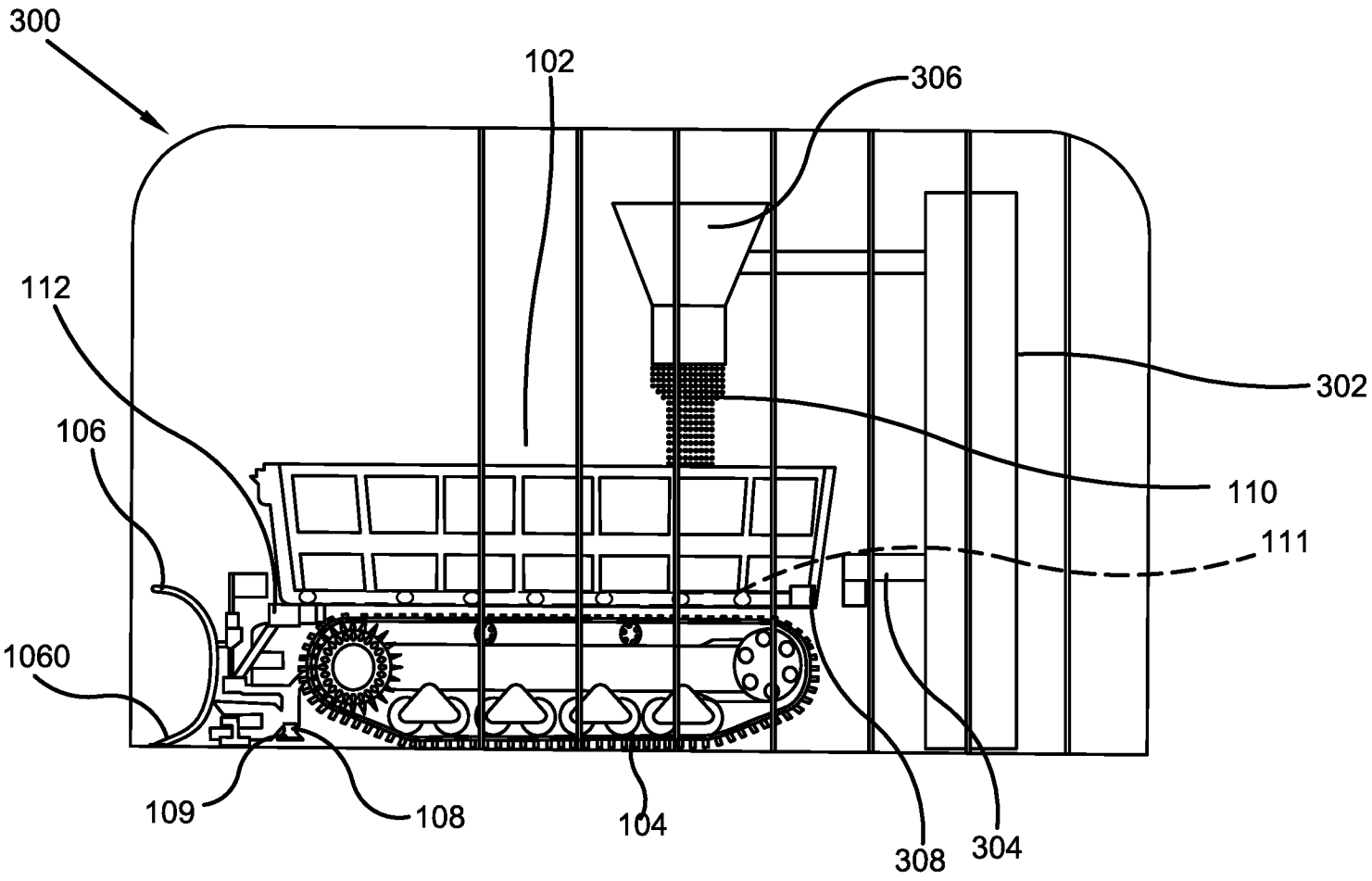
FIG. 3 illustrates a side plan view showing a wireless charging station and refilling station of the automatic salt and fertilizer spreader vehicle of the present invention charging the vehicle and refilling the treatment material in accordance with the disclosed architecture.

FIG. 3 illustrates a side plan view showing a wireless charging station of the automatic salt and fertilizer spreader vehicle of the present invention charging the vehicle and refilling the treatment material in accordance with the disclosed architecture. The spreader vehicle 100 of the present invention comprises a chargeable battery and a wireless charging receiving device 308 at the rear portion, wherein the wireless charging receiving device 308 is disposed on the bottom of the spreader vehicle 100. The vehicle can be wirelessly recharged at a preset site 300 which can be a large hollow rectangular garage-type location including a wireless charging station 302. The charging station 302 can include a wireless charging emitting device 304 which wirelessly connects to the wireless charging receiving device 308 to recharge the internal battery of the vehicle 100. The internal battery provides electrical power to the engine and other electronic components of the vehicle 100 for operation. Further, in differing embodiments the battery may be replaceable as well as rechargeable (as noted) wherein the charging device 308 may charge multiple batteries simultaneously.

In the present embodiment, a sensor can provide a notification to an operator about the low battery level of the vehicle 100 thereby alerting the operator, or the vehicle itself, to move the vehicle 100 to the wireless charging station 302. In one embodiment, a control module of the vehicle 100 controls the automatic moving spreader vehicle to move and return back along the path when the spreading task has been finished.

To refill the desired treatment material in the truck bed 102 for spreading, the preset refilling site 300 can include a material refilling hopper 306. The refilling hopper 306 includes one or more containers housing the material which can be automatically emptied using the refilling hopper 306 into the truck bed 102. Preferably, one or more hollow storage drums with removable lid screws are present on the top of the charging station for an operator to empty treatment materials into the truck bed 102 by way of storage drums 306.

Figure 4:
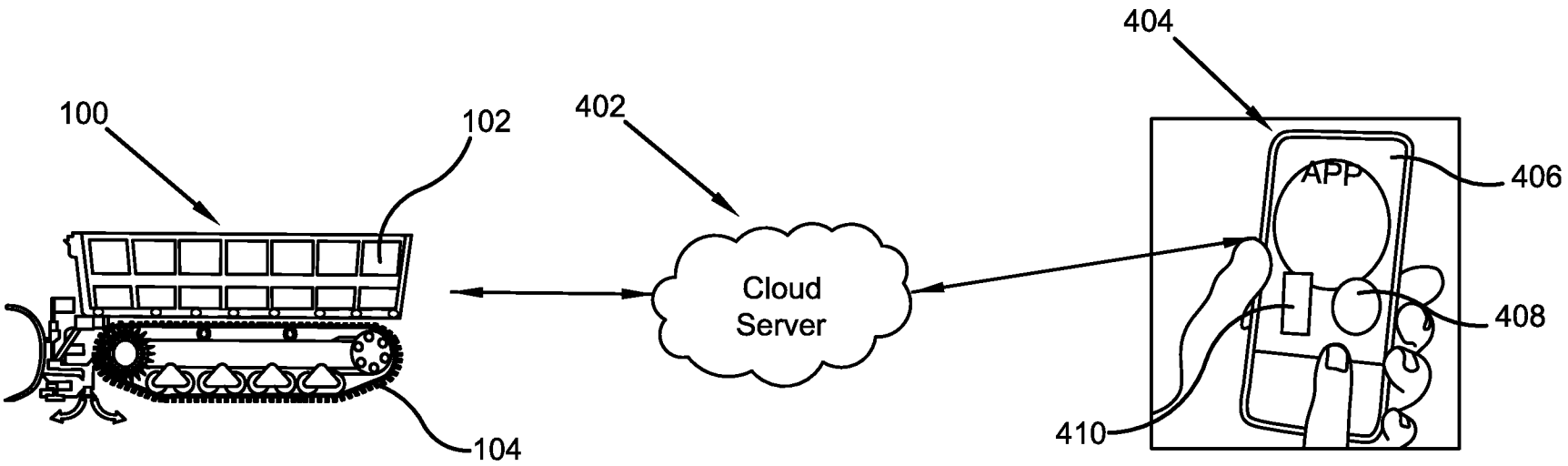
FIG. 4 illustrates a schematic view showing a wireless connection between the treatment material spreading vehicle and a companion mobile application shown in accordance with the disclosed architecture.

FIG. 4 illustrates a schematic view showing the wireless connection between the treatment material spreading vehicle and a companion mobile application showing in accordance with the disclosed architecture. The spreading vehicle 100 can be controlled remotely by a user using a paired and configured mobile application 406. The mobile application 406 can be installed in a handheld electronic device 404 and is configured to control the operations of the vehicle 100 and also to receive a real-time notification indicating status of various parameters such as material level, battery level and location of the vehicle 100. The vehicle 100 may also be steered via the mobile application 406. Further, the vehicle 100 may contain a replaceable hard drive that contains a programmable area or route in which the vehicle 100 will travel. In this regard, the vehicle 100 can be used to autonomously treat multiple lots/land parcels/areas with the same vehicle 100.

In the present embodiment, the vehicle 100 can be registered to a cloud server 402 and tagged to a profile of an operator. The operator can create a profile stored in the cloud server 402 that authorizes the operator to control the operations of the vehicle 100 from the installed mobile application 406. The cloud server 402 can provide a subscription service to the operator for controlling the vehicle 100 remotely, and enabling the authorized application 406 to receive real-time notifications about the status of the vehicle. The vehicle 100 can be registered with a user and when the user is logged in the application 406, the user is provided with an interface to control operations of the vehicle 100.

Using the smartphone application 406, the operator can program the vehicle's specified or predeterminable treatment area along with a time schedule of the treatment. For example, the operator can input longitude and latitude attributes of location in the application using the input device of the electronic device 404 to configure a treatment location. The cloud server 402 receives the longitude and latitude attributes of location and the GPS chip installed in the vehicle 100 is configured to enable movement of the vehicle 100 within the periphery defined within those longitude and latitude attributes. In one embodiment, the operator can draw a schedule of the locations to be treated by the vehicle. In addition to the location, a time schedule can be set by the operator for the vehicle to spread the treatment.

The starting position of the spreading vehicle 100 can be any preset location such as the charging station 302 of the vehicle 100. Similarly, once the spreading task is finished at the configured location, the spreading vehicle 100 can automatically come back to the preset location.

The GPS sensor of the vehicle provides real-time location information to the cloud server 402 that displays the location information on the application 406. Similarly, additional information such as treatment material level 408 and battery level 410 are also shown in real-time on the application 406. It is to be understood that the real-time information is stored in the cloud server 402 for cross verification. Various sensors of the vehicle 100 continuously transmit the information to the cloud server 402 that can also be displayed on the application 406.

Location of the charging station, duration of charging the battery, schedule of spreading of treatment material and any additional setting that can increase the utility of the vehicle 100 for automatic spreading the treatment material at any location can be configured remotely by an operator. The settings are instantly configured in the sensors and modules of the vehicle 100 allowing a complete automated and remotely controlled operation of the spreading unit 100.

Any malfunction in any of the sensors and/or modules of the spreading unit 100 can be instantly notified to both the cloud server 402 and the application 406. Accordingly, a user of the vehicle 100 can take the required actions to repair or replace the malfunctioned sensors or modules for proper functioning of the spreader vehicle 100.

The smartphone application 406 can have limited access by authorized users and enables them to access and monitor operations of the associated spreading vehicle 100. Each of the vehicle owners may have a unique ID that is associated with their corresponding vehicle 100, enabling the operator to control the operations of their vehicle 100. This ensures safe remote operation of the vehicle 100 of the present invention.

Figure 5:
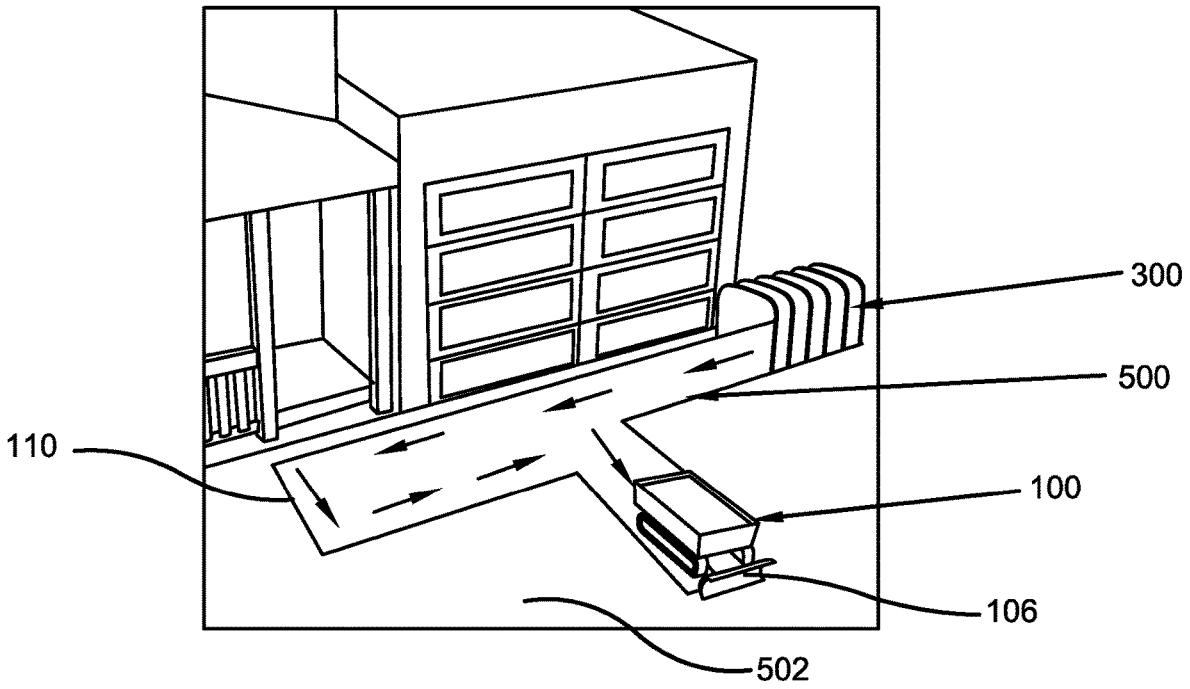
FIG. 5 illustrates a perspective view showing the treatment material spreading unit of the present invention treating a driveway by spreading salt in accordance with the disclosed architecture.

FIG. 5 illustrates a perspective view showing the treatment material spreading unit of the present invention treating a driveway by spreading salt in accordance with the disclosed architecture. The treatment material spreading unit 100, once configured by an operator using the smartphone application, initiates the operation of spreading treatment material, such as salt, in the configured treatment area 500. The treatment area 500 is pre-configured by the operator or can alternatively be operated and configured in real-time by the operator. The spreading unit 100 starts the operation from a preset location 300 and starts spreading the treatment material 110 to treat the area. In one potential embodiment, the driveway 502 can be treated by spreading salt 110 in a predetermined configuration. The front plow 106 can be used to plow the snow as well for a more effective salt 110 spreading application by the spreading unit 100.

In another potential embodiment, the spreading unit 100 can be used for providing fertilizers to an agricultural field. The location of the field can be pre-configured and the fertilizer as a treatment material can be stored in the truck bed of the spreading unit 100. For recharging the internal battery of the spreading unit 100, the wireless receiving device is used for wirelessly charging the battery. However, a wired mechanism for recharging the battery is within the scope of the present invention. In one embodiment, the vehicle 100 may also be capable of taking soil samples and analyzing said samples via the mobile application 406. Accordingly, the application 406 can then calculate what treatment material and how much material must be used to satisfy any desired pH levels of soil within a specified area (e.g. square feet area or acreage area).

Although various embodiments of the present invention enable an operator to remotely control and operate the spreading unit/vehicle 100, the scenario of an active driver associated with the spreading vehicle 100 for operating the vehicle 100 is also under the scope of the invention. The operation would be similar to a conventional snowplow truck with the manual controls provided to the operator for operating the vehicle 100.

It is also worth noting that the front plow is removeable for spreading-use only, and that the spreading unit/vehicle 100 is capable of adapting technology such as, but not limited to, sonar/radar/lidar/image processing AI for maneuverability, as well as pH testing with results available on the mobile app for treatment material suggestions (i.e. limestone to make soil more acidic).

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "automatic salt and fertilizer spreader vehicle", "treatment material spreading vehicle", "spreader vehicle", "spreading vehicle", "spreading unit", and "vehicle" are interchangeable and refer to the automatic salt and fertilizer spreader vehicle 100 of the present invention.

Notwithstanding the forgoing, the automatic salt and fertilizer spreader vehicle 100 of the present invention can be of any suitable size and configuration as is known in the art without affecting the overall concept of the invention, provided that it accomplishes the above-stated objectives. One of ordinary skill in the art will appreciate that the size, configuration and material of the automatic salt and fertilizer spreader vehicle 100 as shown in the FIGS. are for illustrative purposes only, and that many other sizes and shapes of the automatic salt and fertilizer spreader vehicle 100 are well within the scope of the present disclosure. Although the dimensions of the automatic salt and fertilizer spreader vehicle 100 are important design parameters for user convenience, the automatic salt and fertilizer spreader vehicle 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method for controlling an automatic material spreader vehicle system, the method comprising the steps of:

providing an automatic material spreader vehicle including a bed for storing and transporting a treatment material;

controlling remotely said automatic material spreader vehicle, wherein said remote controlling includes programming a predeterminable spreading area and a predeterminable spreading time schedule for metering and dispensing of said treatment material from said bed;

returning said automatic material spreader vehicle to a refilling station when said treatment material needs replenishing;

refilling said automatic material spreader vehicle at said refilling station, wherein said refilling station includes a hopper of said treatment material for replenishing consumed said treatment material; and recharging a rechargeable battery at said refilling station for powering said automatic material spreader vehicle, wherein said remote controlling includes a mobile app.

2. The method of claim 1, wherein said remote controlling further comprises:

a proximity sensor for real-time communication with said mobile app for determining a location of said automatic material spreader vehicle;

a material volume sensor for real-time communication with said mobile app for determining and communicating a volume of said treatment material remaining in said bed; and a battery sensor for real-time communication with said mobile app of a status of said rechargeable battery.

3. The method of claim 1 further comprising a removable front plow blade selectively mounted to a front of said spreader vehicle for pushing a substance in front of said automatic material spreader vehicle.

4. The method of claim 1 further comprising a conveyor belt for moving said treatment material through said bed.

* * * * *